US009863420B2

(12) United States Patent
Walder et al.

(10) Patent No.: US 9,863,420 B2
(45) Date of Patent: Jan. 9, 2018

(54) VACUUM PUMP OF LIGHTWEIGHT CONSTRUCTION

(71) Applicant: MAGNA POWERTRAIN BAD HOMBURG GMBH, Bad Homburg (DE)

(72) Inventors: Marcel Walder, Hueckeswagen (DE); Oleksandr Kozin, Bochum (DE); Remigius Szczepanek, Hueckeswagen (DE); Jörg Wallenfels, Plettenberg (DE); Rolf Gerschwinat, Iserlohn (DE); Kornelia Frowein, Wermeiskirchen (DE)

(73) Assignee: MAGNA POWERTRAIN BAD HOMBURG GMBH, Bad Homburg (DE)

( * ) Notice: Subject to any disclaimer, the term of this patent is extended or adjusted under 35 U.S.C. 154(b) by 0 days.

(21) Appl. No.: 14/885,032

(22) Filed: Oct. 16, 2015

(65) Prior Publication Data

US 2017/0058897 A1 Mar. 2, 2017

(30) Foreign Application Priority Data

Aug. 24, 2015 (DE) ..... 10 2015 216 104

(51) Int. Cl.

| | |
|---|---|
| ***F01C 11/00*** | (2006.01) |
| ***F04C 15/00*** | (2006.01) |
| ***F03C 4/00*** | (2006.01) |
| ***F04C 18/344*** | (2006.01) |
| ***F04D 19/04*** | (2006.01) |
| ***F01C 21/08*** | (2006.01) |
| ***F04C 25/02*** | (2006.01) |
| ***F04C 27/00*** | (2006.01) |

(52) U.S. Cl.

CPC ..... *F04C 18/3448* (2013.01); *F01C 21/08* (2013.01); *F04C 18/344* (2013.01); *F04C 25/02* (2013.01); *F04C 27/005* (2013.01); *F04D 19/04* (2013.01); *F04C 2220/10* (2013.01); *F04C 2240/20* (2013.01); *F04C 2240/30* (2013.01); *F04C 2240/56* (2013.01); *F05C 2201/021* (2013.01)

(58) Field of Classification Search

CPC ..... F04C 29/0071; F04C 18/1075; F04C 15/0003; F04C 15/0038; F04D 13/0633; F04D 13/026; F04D 29/04; F01C 19/005; F01C 21/02

USPC ..... 418/55.2, 179, 206.9

See application file for complete search history.

(56) References Cited

U.S. PATENT DOCUMENTS 2,243,899 A * 6/1941 Fulcher ..... F04C 18/352 418/138

6,416,851 B1 7/2002 Kuroiwa et al.

FOREIGN PATENT DOCUMENTS

| | | | |
|---|---|---|---|
| DE | 102009040510 | A1 | 3/2010 |
| DE | 102013105911 | A1 | 1/2014 |
| EP | 1193396 | A2 | 4/2002 |
| JP | 62150094 | A * | 7/1987 |

(Continued)

*Primary Examiner* — Mark Laurenzi
*Assistant Examiner* — Anthony Ayala Delgado
(74) *Attorney, Agent, or Firm* — Dickinson Wright PLLC

(57) ABSTRACT

A vacuum pump having a housing composed of light metal, in which a rotor composed of light metal is rotatably mounted. The rotor driving at least one vane, wherein the rotor is composed of light metal and has at least three different diameters along the axis of rotation thereof.

19 Claims, 1 Drawing Sheet

(56) References Cited

FOREIGN PATENT DOCUMENTS

| | | | |
|---|---|---|---|
| JP | 2004251226 | A | 9/2004 |
| WO | WO 01/48381 | A2 | 7/2001 |

* cited by examiner

VACUUM PUMP OF LIGHTWEIGHT CONSTRUCTION

CROSS-REFERENCE TO RELATED APPLICATIONS

This application claims the benefit and priority of German Application No. DE102015216104.8 filed Aug. 24, 2015. The entire disclosure of the above application is incorporated herein by reference.

FIELD

The invention relates to a vacuum pump of lightweight construction having aluminium components.

BACKGROUND

This section provides background information related to the present disclosure which is not necessarily prior art.

A vacuum pump having a drivable rotor, by means of which at least one vane in a housing can be made to rotate, is known from international publication WO 01/48381 A2. The rotor and/or the vane consist/s of aluminium or of an aluminium alloy. The rotor is produced by machining and by forming without machining, preferably by die casting or extrusion. At least part of the housing of the vacuum pump is likewise produced from aluminium or an aluminium alloy. The rotor and/or the vane is/are anodized. During the anodizing process, a protective oxide layer is formed on the aluminium or the aluminium alloy. The protective oxide layer serves to provide protection against abrasion.

The application of a coating, by anodizing for example, is relatively complex and expensive.

From DE102013105911 A1, it is known that the friction pair of two friction partners consisting of an uncoated aluminium material is particularly advantageous in a vacuum pump. On the one hand, unwanted wear during the operation of the vacuum pump can be kept low by the uncoated aluminium material. Moreover, relatively small gaps between the friction surfaces can be formed using the two friction partners consisting of the uncoated aluminium material. The disadvantage of the solution according to DE 102013105911 A1 is the extremely expensive material of one friction partner.

SUMMARY

This section provides a general summary of the disclosure, and is not a comprehensive disclosure of its full scope or all of its features.

It is the object of the invention to produce a vacuum pump which can be produced at low cost and/or has a long service life and provides advantages in terms of bearings and lubrication.

The object is achieved by a vacuum pump having a housing composed of light metal, in which a rotor composed of light metal is rotatably mounted, said rotor driving at least one vane, wherein the rotor is composed of light metal and has at least three different diameters along the axis of rotation thereof.

The overall weight is greatly reduced by introducing a light metal rotor, e.g. an aluminium rotor, into the vacuum pump.

This gives a rotor with a step such that the rotor is configured to define a bearing region that is distinct from a sealing region. Separating the bearing surfaces of the bearing region from the sealing surfaces of the sealing region allows effective sealing and better pressure distribution in the oil lubrication system. The additional step in the rotor ensures that considerably less air gets into the pump interior owing to the seal.

It is advantageous here that the step has an axial bearing surface and a radial and an axial sealing surface.

The step increases the strength of the rotor.

The selective choice of the materials and the thermal expansion coefficients thereof lead to an improvement in the bearing situation at high and also at low temperatures.

The housing contains a sintered bushing as a bearing for the rotor. This has the advantage that, owing to the different thermal expansion coefficients, the rotor is provided with support which improves at high temperatures. The bearing clearance decreases as the temperature rises and thus compensates the loss of viscosity in the oil in the bearing gap. At low temperatures, the annular gap in the bearing increases and can assist in reducing the internal pressures that briefly arise in the case of a cold start.

The sintered bushing has a cylindrical axial sintered bearing and at least one collar as a radial sintered bearing. The bushing in the aluminium housing can absorb the axial and radial bearing forces so that tilting of the rotor does not occur.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The invention is described below by way of example with reference to the attached drawing.

DETAILED DESCRIPTION OF THE DRAWINGS

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
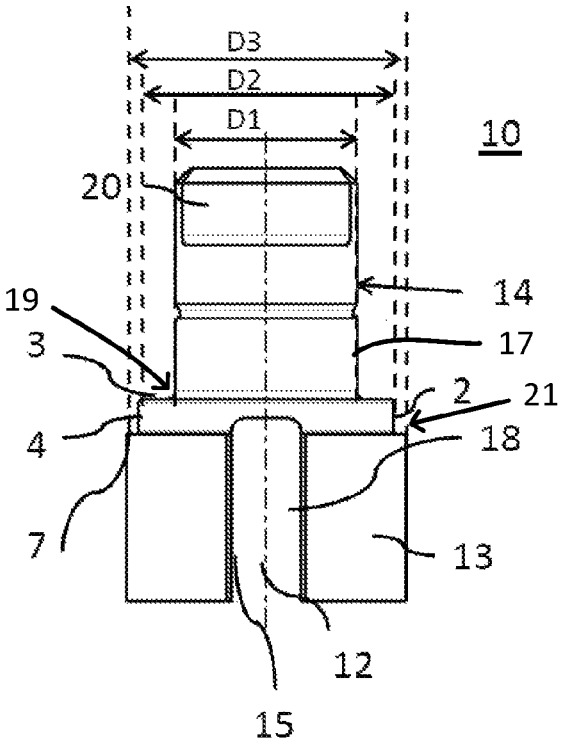
FIG. 1 shows a schematic illustration of the illustrative embodiment of the rotor.
Figure 2:
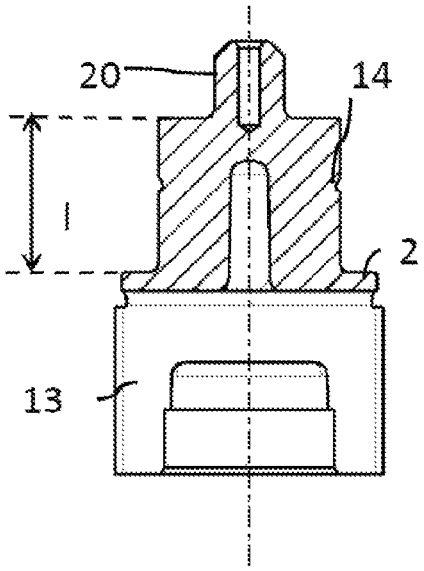
FIG. 2 shows a section along a transverse axis of the rotor.
Figure 3:
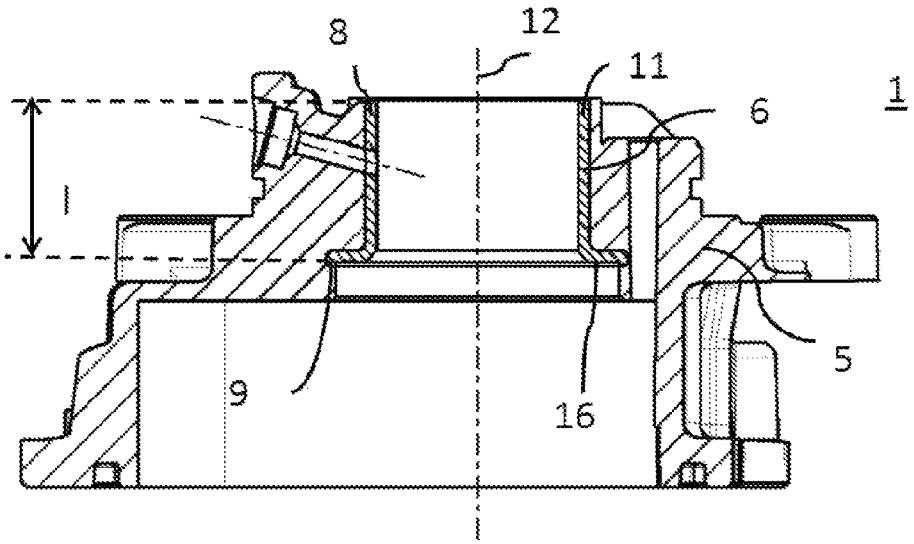
FIG. 3 shows the support of the rotor in the housing.

A vacuum pump 1 is shown in a highly simplified and only partial way in FIG. 3. The vacuum pump 1 comprises a housing 5 having a bearing portion 6.

The vacuum pump 1 is embodied as a vane pump and is used, for example, to produce a vacuum in a vacuum chamber of a brake booster. For this purpose, a rotor 10 is arranged rotatably about an axis of rotation 12 in the housing 5 of the vacuum pump 1.

The axis of rotation 12 of the rotor 10 coincides with a longitudinal axis of the rotor 10. The rotor 10 is driven by a drive shaft, for example, and guides a vane, which is arranged in a vane locating slot 18 in the rotor 10. When the rotor 10 rotates about its axis of rotation 12, there is an increase in volume in a suction chamber of the vacuum pump, causing a working medium to be drawn into the suction chamber. At the same time, there is a decrease in volume in a pressure chamber of the vacuum pump, causing the working medium to be discharged from the pressure chamber.

The rotor 10 comprises a rotor main body 13 and a radial bearing portion 14. The radial bearing portion 14, which has the diameter D1, defines a radial bearing surface 17 which serves to support the rotor 10 rotatably in the housing of the vacuum pump 1, wherein this point of support is the only radial point of support of the rotor 10 in the pump 1. The rotor 10 furthermore has a step 2, which is situated in the diameter D2 of the cylinder between the diameter D1 of the bearing portion 14 and the diameter D3 of the rotor main body 13. On its outward-facing side, the step 2 forms an axial bearing surface 3. In addition, a radial sealing surface 4 and an axial sealing surface 7 are created by the step 2. By separating the axial bearing surface 3 and the radial bearing surface 17 from the axial and radial sealing surfaces 7 and 4, both aims, that of sealing and also that of optimum support, are achieved more effectively. A bearing region 19 of the rotor 10 is defined by the axial bearing surface 3 on the step 2 and the radial bearing surface 17 on the radial bearing portion 14. Likewise, a sealing region 21 of the rotor 10 is defined by the radial sealing surface 4 and the axial sealing surface 7, both associated with the step 2.

A vane locating portion 15 is connected integrally to the bearing portion 14. Like the bearing portion 14, the vane locating portion 15 has the shape of a right circular cylinder, which has a larger outside diameter than the bearing portion 14.

The vane locating portion 15 comprises a vane locating slot 18, which is open at one end and serves to receive or guide the vane of the vane pump. A coupling element 20 is formed on the rotor 10 at the free end of the bearing portion 14. The coupling element 20 serves to connect the rotor 10 to a drive shaft for driving purposes. The rotor 10 according to the invention is composed of light metal, generally of aluminium or of an aluminium alloy, and is therefore light but strong enough not to require support by another bearing. The rotor has a reinforcing collar, the step 2 at the transition from the bearing portion to the rotor main body.

The rotor 10 is inserted into the housing, as shown in FIG. 3. In the bearing portion 6, the housing 5 has a sintered bushing 8. The sintered bushing extends along a length l which corresponds to the length of the radial bearing portion 14 of the rotor.

The sintered bushing 8 has a collar 9 in the direction of the pump working chamber. The sintered bushing 8 is produced from a ferrous material, representing an optimum combination with an aluminium rotor. In this case, the material of the sintered bushing has a different thermal expansion coefficient from the light metal housing. The sintered bushing 8 is moulded in during the production of the light metal housing.

The sintered bushing 8 has a cylindrical region as a radial sintered bearing 11 and, in the region of the collar 9, an axial sintered bearing 16. The radial bearing surface 17 associated with the radial bearing portion 14 and the axial bearing surface 3 associated with the step 2 rest on the two sintered bearings.

The sintered bushing 8 can be embodied as a deep-drawn part or a turned part.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

LIST OF REFERENCES

1 vacuum pump
2 step
3 axial bearing surface
4 radial bearing surface
5 housing
6 bearing portion
7 axial sealing surface
8 sintered bushing
9 collar
10 rotor
11 radial sintered bearing
12 axis of rotation
13 rotor main body
14 radial bearing portion
15 vane locating portion
16 axial sintered bearing
18 vane locating slot
20 coupling element

What is claimed is:

1. A vacuum pump comprising:

a housing disposed about an axis;

a rotor disposed in the housing and rotatable about the axis; and the rotor having a main body, a radial bearing portion extending axially from the main body and a step positioned between the main body and the radial bearing portion, the step having a diameter being greater than a diameter of the radial bearing portion and smaller than a diameter of the main body;

wherein the radial bearing portion of the rotor defines a radial bearing surface extending axially, wherein the step defines an axial bearing surface extending generally perpendicularly to the axis away from the radial bearing surface, wherein the step further defines a radial sealing surface extending axially from the axial bearing surface, wherein the main body of the rotor defines an axial sealing surface extending generally perpendicularly to the axis away from the radial sealing surface, and wherein a bearing region of the rotor is defined by the axial and radial bearing surfaces and a sealing region of the rotor is defined by the radial and axial sealing surfaces.

2. A vacuum pump as set forth in claim 1 further including a bushing disposed in the housing and receiving the radial bearing portion of the rotor.

3. A vacuum pump as set forth in claim 2 wherein the bushing is sintered.

4. A vacuum pump as set forth in claim 2 wherein the bushing includes a cylindrical region extending axially, and a collar extending generally perpendicularly to the axis from an end of the cylindrical region.

5. A vacuum pump as set forth in claim 4 wherein the radial bearing surface of the rotor engages the cylindrical region of the bushing, and wherein the axial bearing surface of the rotor engages the collar of the bushing for providing support to the rotor during rotation of the rotor.

6. A vacuum pump as set forth in claim 2 wherein the radial bearing portion of the rotor extends axially along a length, and wherein the bushing extends axially along a length that is the same as the length of the radial bearing portion.

7. A vacuum pump as set forth in claim 2 wherein the housing and rotor are each of an aluminium or aluminium alloy material, and wherein the bushing is of a ferrous material.

8. A vacuum pump as set forth in claim 1 further including a vane connected to and rotatable with the rotor in the housing.

9. A vacuum pump as set forth in claim 8 wherein an end of the rotor defines a vane locating slot, and wherein the vane is positioned in the vane locating slot.

10. A vacuum pump as set forth in claim 1 further including a coupling element at an end of the bearing portion of the rotor for connecting the rotor to a drive shaft.

11. A vacuum pump for producing a vacuum in a vacuum chamber of a brake booster, the vacuum pump comprising:

a housing disposed about an axis;

a sintered bushing disposed in the housing along the axis;

a rotor received by the sintered bushing and rotatable about the axis;

a vane connected to and rotatable with the rotor in the housing;

the rotor having a main body and a radial bearing portion extending axially from the main body;

a step positioned between the main body and the radial bearing portion such that the rotor defines a bearing region and a sealing region; and the step having a diameter being greater than a diameter of the radial bearing portion and smaller than a diameter of the main body.

12. A vacuum pump as set forth in claim 11 wherein the radial bearing portion of the rotor defines a radial bearing surface extending axially, wherein the step defines an axial bearing surface extending perpendicularly to the axis away from the radial bearing surface, wherein the step further defines a radial sealing surface extending axially from the axial bearing surface, wherein the main body of the rotor defines an axial sealing surface extending perpendicularly to the axis away from the radial sealing surface, and wherein the bearing region of the rotor is defined by the axial and radial bearing surfaces and the sealing region of the rotor is defined by the radial and axial sealing surfaces.

13. A vacuum pump as set forth in claim 11 wherein the sintered bushing includes a cylindrical region extending axially, and a collar extending perpendicularly to the axis from an end of the cylindrical region.

14. A vacuum pump as set forth in claim 13 wherein the radial bearing surface of the rotor engages the cylindrical region of the bushing, and wherein the axial bearing surface of the rotor engages the collar of the bushing for providing support to the rotor during rotation of the rotor.

15. A vacuum pump as set forth in claim 11 wherein the radial bearing portion of the rotor extends axially along a length, and wherein the sintered bushing extends axially along a length that is the same as the length of the radial bearing portion.

16. A vacuum pump as set forth in claim 11 wherein the housing and rotor are each of an aluminium material, and wherein the bushing is of a ferrous material.

17. A vacuum pump for producing a vacuum in a vacuum chamber of a brake booster, the vacuum pump comprising:

a housing of an aluminum material disposed about an axis;

a rotor of an aluminum material disposed in the housing and rotatable about the axis;

a vane connected to and rotatable with the rotor in the housing;

the rotor having a main body having a first diameter and a radial bearing portion extending axially from the main body and having a second diameter being smaller than the first diameter of the main body; and a step positioned between the main body and the radial bearing portion such that the rotor defines a bearing region and a sealing region, the step having a third diameter being smaller than the first diameter of the main body and larger than the second diameter of the radial bearing portion.

18. A vacuum pump as set forth in claim 17 wherein the radial bearing portion of the rotor defines a radial bearing surface extending axially, wherein the step defines an axial bearing surface extending perpendicularly to the axis away from the radial bearing surface, wherein the step further defines a radial sealing surface extending axially from the axial bearing surface, wherein the main body of the rotor defines an axial sealing surface extending perpendicularly to the axis away from the radial sealing surface, and wherein the bearing region of the rotor is defined by the axial and radial bearing surfaces and the sealing region of the rotor is defined by the radial and axial sealing surfaces.

19. A vacuum pump as set forth in claim 17 further including a sintered bushing disposed in the housing and receiving the radial bearing portion of the rotor, wherein the sintered bushing includes a cylindrical region extending axially and a collar extending perpendicularly to the axis from an end of the cylindrical region, and wherein the radial bearing surface of the rotor engages the cylindrical region of the bushing, and wherein the axial bearing surface of the rotor engages the collar of the bushing for providing support to the rotor during rotation of the rotor.

* * * * *